US010259100B2

(12) United States Patent
Baker et al.

(10) Patent No.: US 10,259,100 B2
(45) Date of Patent: Apr. 16, 2019

(54) INTERNAL WELD BLASTING

(71) Applicant: ShawCor Ltd., Toronto (CA)

(72) Inventors: Brian Baker, Calgary (CA); Randy Danderfer, Toronto (CA)

(73) Assignee: Shawcor Ltd., Toronto (CA)

( * ) Notice: Subject to any disclaimer, the term of this patent is extended or adjusted under 35 U.S.C. 154(b) by 18 days.

(21) Appl. No.: 15/383,886

(22) Filed: Dec. 19, 2016

(65) Prior Publication Data

US 2018/0169834 A1 Jun. 21, 2018

(51) Int. Cl.

| | |
|---|---|
| ***B24C 3/16*** | (2006.01) |
| ***B24C 3/32*** | (2006.01) |
| ***B24C 1/08*** | (2006.01) |
| ***B24C 5/06*** | (2006.01) |

(52) U.S. Cl.
CPC ..... *B24C 3/325* (2013.01); *B24C 1/08* (2013.01); *B24C 3/16* (2013.01); *B24C 5/066* (2013.01)

(58) Field of Classification Search
CPC ..... B24C 3/325; B24C 1/08; B24C 3/16
USPC ..... 451/38, 95, 96, 97, 51, 61
See application file for complete search history.

(56) References Cited

U.S. PATENT DOCUMENTS

| | | | | |
|---|---|---|---|---|
| RE20,538 E * | 10/1937 | Elwood | B24C 5/068 | 451/91 |
| 2,132,311 A * | 10/1938 | Elwood | B24C 3/14 | 451/80 |
| 3,750,339 A * | 8/1973 | Barnes | B08B 9/045 | 451/38 |
| 3,835,587 A * | 9/1974 | Hall, Jr. | B24C 3/325 | 451/38 |
| 4,563,841 A * | 1/1986 | Hart | B24C 3/325 | 118/DIG. 10 |

* cited by examiner

*Primary Examiner* — Robert Rose
(74) *Attorney, Agent, or Firm* — Gregory L. Porter; Hunton Andrews Kurth LLP

(57) ABSTRACT

This disclosure provides a new internal weld blasting system for blasting the internal surfaces of pipes, and the method of use thereof. The system comprises a control cage having two relatively narrow openings. An impeller forces abrasives onto a blast wheel, which in turn sprays the abrasives onto the internal surfaces of the pipes.

20 Claims, 4 Drawing Sheets

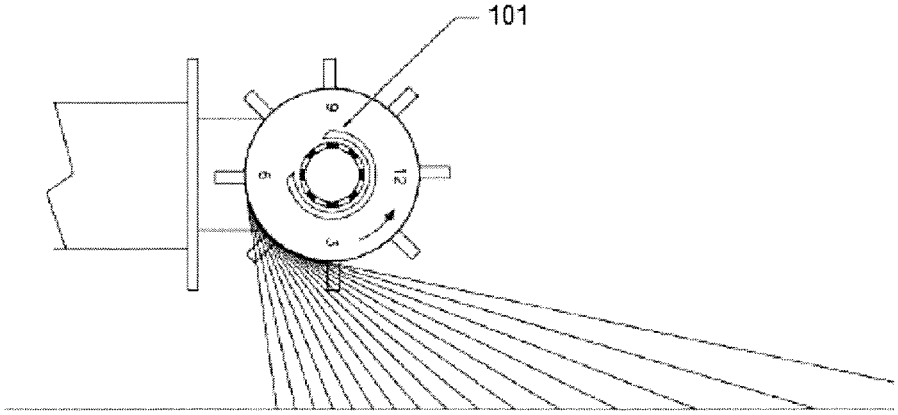
Figure 1 [PRIOR ART]
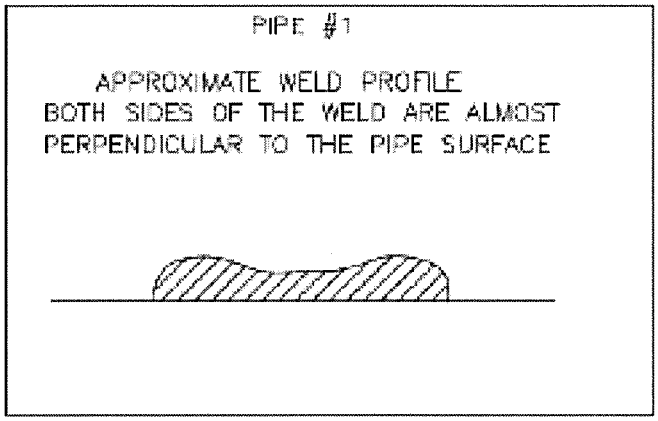
Figure 2A [PRIOR ART]
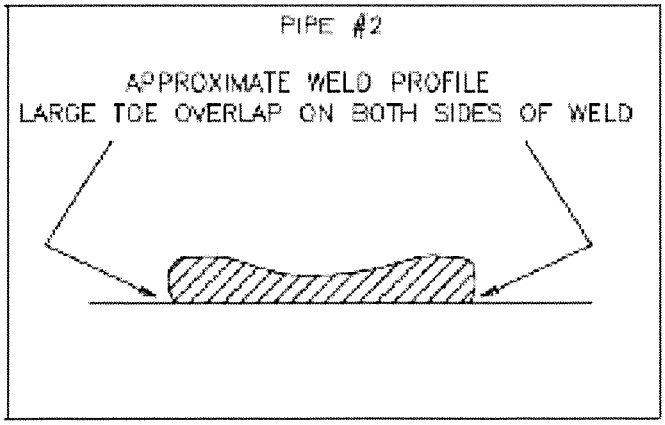
Figure 2B [PRIOR ART]

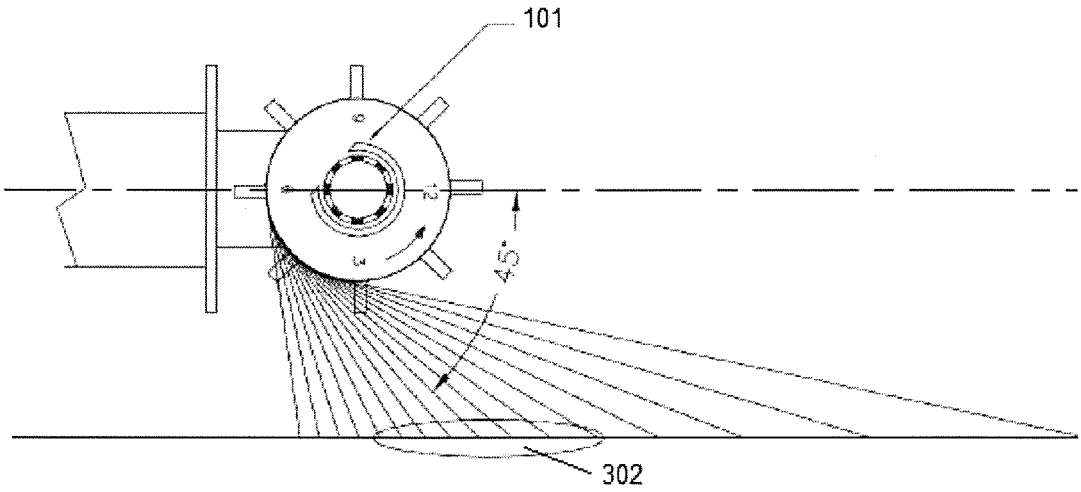
Figure 3 [PRIOR ART]
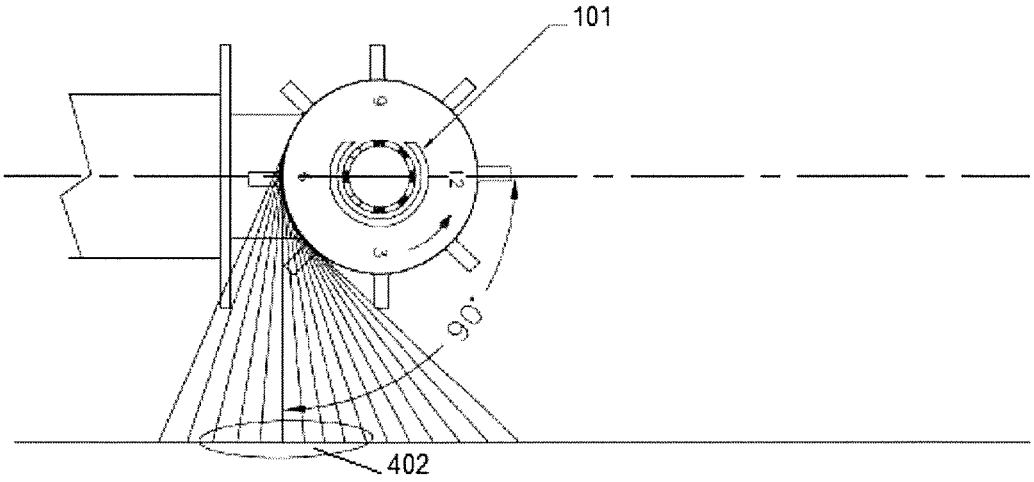
Figure 4 [PRIOR ART]

INTERNAL WELD BLASTING

TECHNICAL FIELD

The present disclosure relates to an internal weld blasting system for the internal surface of pipes and the method of use thereof. The pipes may be used for oil, gas and water pipelines.

BACKGROUND OF THE INVENTION

Many pipes used for pipelines are manufactured by a welding process. The welds are usually girth welds or spiral welds. The pipes made this way have weld beads along the weld that protrude from the rest of the pipe surface. The internal surfaces of the pipes may also have corrosions. It is often necessary to prepare and clean the internal surfaces for subsequent coatings applications or to remove the corrosions.

Internal blasting is a method commonly used to prepare or clean the internal surfaces of the pipes. During internal blasting, abrasives are blasted toward the internal surface either by a mechanical turbine wheel or in a compressed air stream under high pressure. Commonly used abrasives include grit and shot blast media of various shapes and sizes, depending on the desired cleanliness and/or anchor profile necessary for satisfactory coating.

Conventional internal weld blasting systems normally blast at an impingement angle intended to facilitate blast efficiency and removal of residual abrasives from the target surface. Common conventional system uses a control cage with a single 70 deg opening, resulting in the abrasives spraying from the turbine wheel at a 70 deg angle which is directed so that the center of mass of the sprayed abrasives is slightly ahead of the blast wheel, wherein the center of mass impacts the weld, which provides adequate cleaning of the front side and top section of the weld but fails to clean the back side of the weld leaving an unblasted shadow. When a pipe contains a raised weld seam, a "shadow" is created on the leeward side of the weld that receives reduced blast exposure and as a result does not achieve the intended surface condition. This can result in failure to meet regulatory or client specification, and/or result in inadequate coating adhesion.

BRIEF SUMMARY OF THE INVENTION

According to one aspect of the invention, an internal weld blasting system is provided with a modified design of the control cage. The modified control cage is modified from a single, wide opening with an average angle of impingement of about 70 degrees, to two restricted openings having smaller angle of impingement. It is understood that there may be more openings depending on the requirements of blasting.

In some embodiments, the pipe is rotated at a high rate that is less than the centrifugal critical rotation speed for the diameter of the pipe being processed for internal blasting.

In some embodiments, ventilation air flow is provided to clear the target area of residual blast media.

According to another aspect of the invention, wear/protection guards may be added in the system to avoid damage/wear of blast boom components exposed to the blast media with the adjusted angle.

BRIEF DESCRIPTION OF THE DRAWINGS

Reference will now be made, by way of example, to the accompanying drawings which show example embodiments of the present application, and in which:

FIG. 1 is a top view of a conventional internal weld blasting system;

FIG. 2A is a section view of the weld of pipes of set 1;

FIG. 2B is a section view of the weld of pipes of set 2;

FIG. 3 is top view of the conventional internal weld blasting system blasting on a pipe, with the middle of the control cage opening between the 7 and 8 o'clock positions.

FIG. 4 is a top view of the conventional internal weld blasting system blasting on a pipe, with the middle of the control cage opening at 9 o'clock position.

DESCRIPTION OF EXAMPLE EMBODIMENTS

Figure 5:
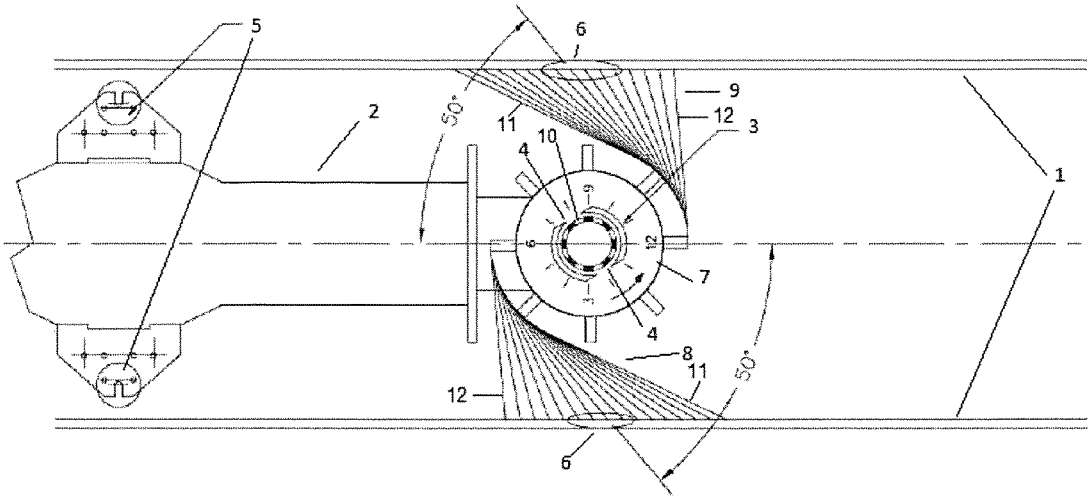
FIG. 5 is a top view of an embodiment of the internal weld blasting system of this invention blasting on a pipe.

In various examples, the present disclosure describes an internal weld blasting system. The system and the components therein may be of various sizes suitable for different pipes.

A Bauhuis™ Internal Blaster (Bauhuis Group B.V., The Netherlands), a conventional, prior art, internal hydraulic powered turbine wheel weld blasting system, is shown in FIG. 1. It was used to clean two set of target pipes, using conventional methodology, as follows. The system was fitted with a 24 to 48 inch blast head. A blast wheel rotates in an anti-clockwise direction at approximately 2600 rpm. Abrasives was fed through a 70 degree control cage 101, resulting in a 70 degree abrasives blast spray pattern. The middle of the 70 degree opening 101 is set at between 7 and 8 o'clock positions. FIG. 1 shows a conventional, prior art, internal hydraulic powered turbine wheel weld blasting system.

Each target pipe was prepared with a weld having a width of approximately 15 mm and a height of approximately 2 to 2.5 mm. The weld of Pipe set 1 had a profile approximately as illustrated in FIG. 2A, wherein both sides of the weld are almost perpendicular to the pipe surface. The weld of Pipe set 2 had a profile approximately as illustrated in FIG. 2B, wherein the large toe overlap on both sides of weld.

The internal weld blasting system of FIG. 1 was used to clean a pipe of set 1, with the abrasives sprayed from the left side of the weld, as shown in FIG. 3. During operation, the blaster produced an abrasives spray angle of approximately 45 degrees from the centerline of the pipe to the center of mass 302 of the sprayed abrasives, which is slightly ahead of the blast wheel. The blasting produced a clear un-blasted shadow on the back side of the weld equal to the height of the weld from the toe to the crown approximately 2 mm. The front side of the weld was completely cleaned except for a very fine line at the toe of the weld that was hardly visible to the naked eye and could likely be removed or reduced by varying the blast media particle size.

The same internal weld blasting system was used to clean a pipe of set 2, except that the 70 degree control cage 101 was rotated 45 deg clockwise so that the middle of the opening was at 9 o'clock position, producing an abrasives spray angle approximately 90 degrees measured from the center of mass 402 of the sprayed abrasives to the centerline of the pipe, as shown in FIG. 4 (meaning, since the control cage was set at 70 degrees, an abrasives blast spray angle of approximately 55 to 125 degrees). The result showed that blasting this way was very effective at cleaning the whole weld profile except for the toe, where a clear un-blasted line about 0.25 mm thick was left along the length of the toe on both sides of the weld.

The internal weld blasting system of FIG. 4 was used to clean a pipe of set 1 that had already been blasted using the internal weld blasting system of FIG. 3. As a result, the weld shadow was completely removed but left a thin un-blasted line along the length of the backside toe that could clearly be seen by the naked eye.

The internal weld blasting system of FIG. 4 was used to clean a pipe of set 1. The result confirmed that blasting at 90 deg to the pipe surface will clean both sides of the weld even if the weld has steep sides but will always leave an un-blasted line along the length of the toes on both sides.

The internal weld blasting system of FIG. 3 was used to clean a pipe of set 2. This resulted in a clear weld shadow on the back side of the weld as could be expected. The front side showed very thin lines of contamination especially in the overlapping areas.

Thus, the conventional internal weld blasting system was shown as less than ideal for completely removing the contamination from both sides of the weld when cleaning the internal surfaces of the pipes.

FIG. 5 shows one embodiment of the internal weld blasting system of the present invention. The blast head 2 of the internal weld blasting system is disposed within a pipe 1. The blast head 2 has a control cage 3. The control cage 3 is provided with two openings 4. Each opening may be less than 70 degrees. In some embodiments, each opening is 50 degrees. In some embodiments, each opening is 30 degrees. In some embodiments, the two openings are of different angles. The angle of the spray pattern 8 or 9 measured between the leading edge 12 and the lagging edge 11 is the same as the angle of the control cage opening each spray pattern 8 or 9 originates from. The two openings may be disposed anywhere around the control cage 3 depending on the particular application.

In preferred embodiments, the centers of the two openings are disposed at 2 and 8 o'clock positions, i.e., the centerlines of the two openings are each 50 degrees from the centerline of the pipe, and the centerlines of the two openings are 180 degrees apart. It is understood that the control cage may be made of any suitable material known in the field and manufactured with any suitable methods known in the field.

The internal weld blasting system may also comprise roller rings 5 to assist movement of the internal weld blasting system within the pipe 1.

The internal weld blasting system further comprises an impeller 10 and a blast wheel 7. In preferred embodiments, the impeller 10 and the blast wheel 7 are fixed together and rotating at the same speed. The impeller 10 is configured to receive abrasives and distribute the abrasives onto the blast wheel 7. In some embodiments, the abrasive is fed into the impeller 10 via a belt feed conveyor.

It is understood that abrasives of various characteristics may be chosen for blasting based on the characteristics of the surfaces to be blasted and the technical specification to be achieved. The abrasives may be grit, shot blast media, their mixture thereof or any other suitable abrasives known in the field.

In operation, the abrasives are fed into the impeller 10, which may be rotating while receiving the abrasives. The abrasives then exit from the two openings 4 by centrifugal force of the impeller 10 within the control cage 3 and enter the blast wheel 7. During blasting, the blast wheel 7 rotates at a rate of rotation suitable for the characteristics of the surface and the abrasives and the abrasives are accelerated on the blast wheel 7. It is understood that the blast wheel may rotate clockwise or anti-clockwise. In preferred embodiments, the blast wheel rotates at approximately 2600 rpm. Finally, the abrasives exit from the blast wheel 7 by centrifugal force and sprays onto two areas of the internal surface of the pipe.

In FIG. 5, the abrasives exit at 6 and 12 o'clock positions from the blast wheel. It is understood that the abrasives may be sprayed from any other suitable positions from the blast wheel 7, which may be changed by changing the position of the control cage openings 4. In some embodiments, the abrasives exit the blast wheel 7 at about 180 degrees after the abrasives exits the control cage openings. In preferred embodiments, the abrasives exit the blast wheel 7 at about 150 degrees after the abrasives exit the control cage openings.

The result of a 10-second blast on a stationary pipe shows that the blast patterns and blast effectiveness are equal on both sides. With the two openings 4 at 8 and 2 o'clock positions, respectively, the blast sprays 8 and 9 hit the welds at about 50 degrees, measured from the center of mass 6 of the abrasives sprayed from the center line of the pipe 1. In preferred embodiments, the center of mass 6 overlaps with the weld to be blasted.

It is understood that abrasives of various characteristics may be chosen for blasting based on the characteristics of the surfaces to be blasted and the technical specification to be achieved. The abrasives may be grit, shot blast media, their mixture thereof or any other suitable abrasives known in the field.

It is understood that the internal weld blasting system may be adapted to be used on pipes of different lengths and internal diameters.

Figure 6:
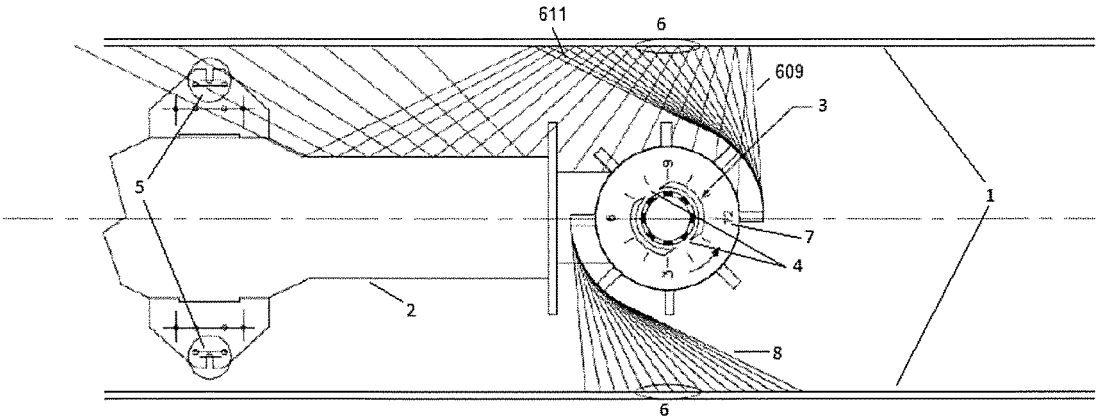
FIG. 6 is a top view of an embodiment of this invention blasting on a pipe, which also shows the trajectories of the abrasives hitting the blaster head.

However, as shown in FIG. 6, the blast spray 609 produces a much longer spray pattern on the lagging side 611, which is caused by abrasives rebounding off the side of the blast head.

In this blast, the side of the blast head 2 that the abrasives rebounds onto and the roller ring 5 thereon are covered with masking tape to evaluate the impact of the blast abrasives bouncing back from the surface of the pipe 1. The spray pattern 609 shows the trajectory of the abrasives bouncing onto and off the surface of the pipe 1 and the blast head 2.

The result of a 90-second blast on a 12-foot long section of a pipe with an internal diameter of 36" shows that the embodiment is very effective at cleaning the whole weld profile right down to the toes on both sides of the weld. However, there is abrasion on the blast head 2 and the roller ring 5.

The results of the blasts shown in FIGS. 5 and 6 also shows that the welds are cleaned effectively regardless of which side the abrasives hit the weld from.

In some embodiments, a wear/protection guard may be attached to the internal weld blasting system to prevent the abrasives from bouncing onto the blast head 2 and the roller ring 5. In some embodiments, the wear/protection guard may be a blast shield.

Figure 7:
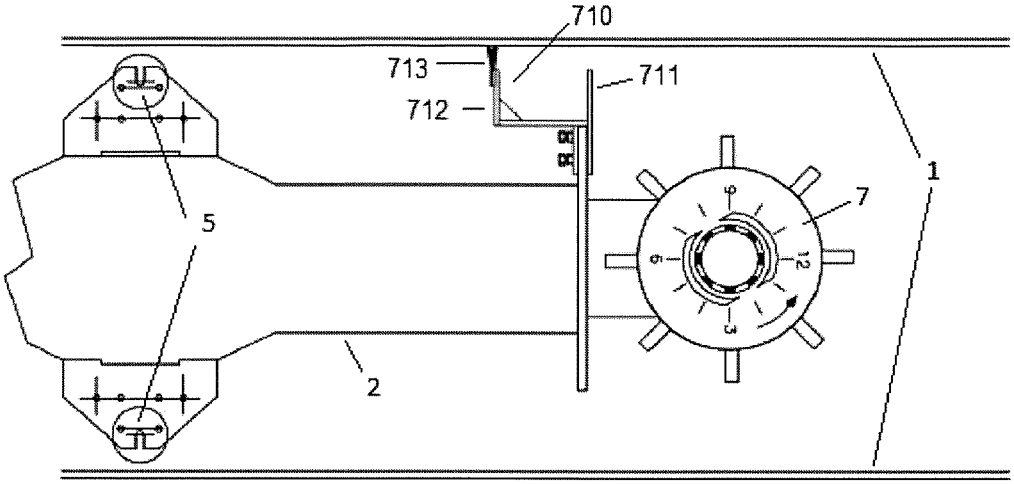
FIG. 7 is a top view of an embodiment of this invention with a blast shield installed.
Figure 8:
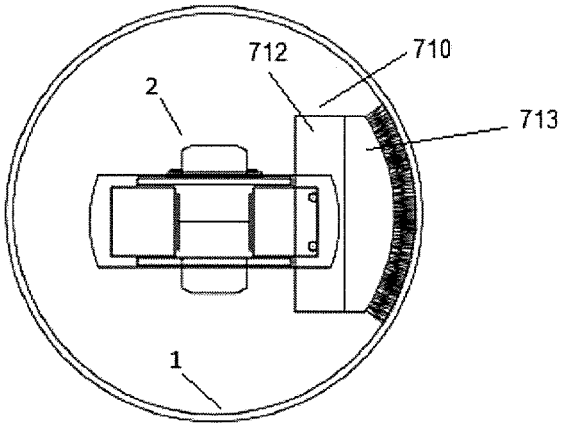
FIG. 8 is a front view of the embodiment of FIG. 7, viewed from the roller ring end.
Figure 9:
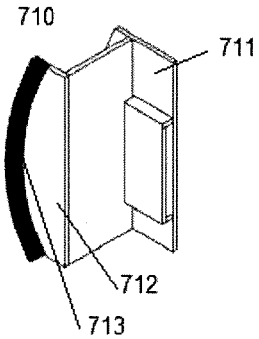
FIG. 9 is a perspective view of the blast shield.

FIG. 7 shows a blast shield 710 attached to the internal weld blasting system to avoid abrasion on the blast head 2 and the roller ring 5. The blast shield 710 may be removably or fixedly attached to the blast head 2.

In some embodiments, the blast shield 710 may comprise two plates 711 and 712, and the plates 711 and 712 may be disposed at any suitable angle relative to the internal surface of the pipe. In preferred embodiments, each of the plates being substantially perpendicular to the center line of the blast head 2. In some embodiments, plate 712 may be positioned further away from the blast wheel 7 than plate 711. There may be gaps between the two plates 711 and 712 and the internal surface of the pipe 1. The width of the gap between the two plates 711 and 712 may be adjusted depending on the application. It is understood that the distances between the edges of plates 711 and 712 to the internal surface of the pipe 1 may be adjusted depending on the application.

The blast shield 710 may be made of any suitable material known in the field. In preferred embodiments, the blast shield 710 may be made of carbon steel. In more preferred embodiments, the blast shield 710 may be made of 14% manganese steel.

In some embodiments, the blast shield 710 may be fitted with removable liners on the surfaces. In preferred embodiments, the removable liners are fitted on the surfaces of the blast shield that receive the rebounded abrasives.

In some embodiments, a plate extension 713 may be attached to plate 712 to close the gap between plate 712 and the internal surface of the pipe 1. The plate extension 713 may be removably or fixedly attached to plate 12.

The plate extension 713 may be made of any material that does not affect the relative movement of the internal weld blasting system and the pipe. In some embodiments, the plate extension 713 may be a piece of rubber, silicone, reinforced rubber, or reinforced silicone, formed to fit snugly the internal surface of the pipe 1. In some embodiments, the plate extension 713 may be a brush formed to fit snugly the internal surface of the pipe 1. The plate extension 713 may be made of any other suitable material and/or of any suitable shape known in the field.

The blast shield 710 may be of different sizes to best fit the internal surfaces of the pipes to protect the blast head 2 and the roller ring 5.

The internal weld blasting system shown in FIG. 7 was used to blast the internal surfaces of two eighty-foot long pipes. The result shows that the welds can be completely cleaned down to the toes of the welds. At the same time, no abrasion was observed on the blast head 2 and the roller ring 5.

The method for using the internal weld blasting system of this invention includes several steps:

a. dispose the internal weld blasting system inside a pipe;

b. transport abrasives into the internal weld blasting system; and c. spray the abrasives onto the internal surface of the pipe. The abrasives may be sprayed onto the internal surface of the pipe using any suitable spray pattern known in the field. In preferred embodiments, the centerline of the spray pattern is 50 degrees from the centerline of the pipe.

In some embodiments, the pipe may be rotated while the abrasives are being sprayed. In preferred embodiments, the pipe rotates at a speed just below centrifugal critical speed corresponding to the internal diameter of the pipes. For example, the rotating speed is about 36 RPM for a pipe with an internal diameter of 36". In preferred embodiment, when the pipe rotates, the abrasives from the two openings blast on the front and back side of the weld, respectively. Rotating the pipe while it is being blasted may be advantageous when there are multiple welds, girth or spiral welds to be blasted.

In some embodiments, the internal weld blasting system moves through the pipe as the pipe rotates so that the full length of the internal surface of the pipe may be blasted.

In the blasting process, ventilation air flow may be provided to remove abrasives and pieces of welds and other contaminations blasted off the internal surfaces of the pipes from the interiors of the pipes. The rotation of the pipes may assist the removal.

The embodiments of the present disclosure described above are intended to be examples only. The present disclosure may be embodied in other specific forms. Alterations, modifications and variations to the disclosure may be made without departing from the intended scope of the present disclosure. While the system, devices and processes disclosed and shown herein may comprise a specific number of elements/components, the systems, devices and assemblies could be modified to include addition or fewer of such elements/components. For example, while any of the elements/components disclosed may be referenced as being singular, the embodiments disclosed herein could be modified to include a plurality of such elements/components. Selected features from one or more of the above-described embodiments may be combined to create alternative embodiments not explicitly described. All values and subranges within disclosed ranges are also disclosed. The subject matter described herein intends to cover and embrace all suitable changes in technology. All references mentioned are hereby incorporated by reference in their entirety.

The invention claimed is:

1. A internal weld blasting system, comprising:

a blast head, a control cage having two openings, an impeller, a blast wheel;

a blast shield; and a plate extension, wherein the blast head, control cage, impeller and blast wheel are configured for disposition inside a pipe, wherein the blast shield comprises two plates, and wherein the plate extension is configured to be in contact with the internal surface of the pipe during blasting.

2. The internal weld blasting system of claim 1, wherein at least one of the two openings has an open angle which can be varied by a user.

3. The internal weld blasting system of claim 1, wherein one of the two openings is a 30-degree opening.

4. The internal weld blasting system of claim 1, wherein one of the two openings is a 50-degree opening.

5. The internal weld blasting system of claim 1, wherein the two openings are of different angles.

6. The internal weld blasting system of claim 1, wherein the centerlines of the two openings are 180 degrees from each other.

7. The internal weld blasting system of claim 1, wherein the control cage is rotatable.

8. The internal weld blasting system of claim 1, wherein the centerline of each of the two openings is 60 degrees from the longitudinal centerline of a pipe when the internal weld blasting system is disposed in the pipe.

9. The internal weld blasting system of claim 1, wherein the two plates are substantially perpendicular to a center line of the blast head.

10. The internal weld blasting system of claim 1, wherein the two plates are positioned at different distances from the blast wheel.

11. The internal weld blasting system of claim 1, wherein the plates are made of carbon steel.

12. The internal weld blasting system of claim 1, wherein the plates are made of 14% Manganese steel.

13. The internal weld blasting system of claim 1, further comprising a removable liner disposed on the blast shield.

14. The internal weld blasting system of claim 1, wherein the plate extension is attached to the plate positioned further away from the blast wheel.

15. The internal weld blasting system of claim 1, wherein the plate extension is a brush.

16. The internal weld blasting system of claim 1, wherein the plate extension is made of rubber, silicone, reinforced rubber or reinforced silicone.

17. A method for blasting the internal surface of a pipe using the internal weld blasting system of claim 1, comprising:

a. disposing the internal weld blasting system in a pipe;

b. transporting abrasives into the internal weld blasting system;

c. supplying the abrasives to the blast wheel by the centrifugal force of the impeller;

d. spraying the abrasives onto the internal surface of the pipe by the centrifugal force of the blast wheel; and e. providing ventilation air flow at the same time as spraying the abrasives.

18. The method of claim 17, further comprising: rotating the pipe while spraying the abrasives.

19. A method for blasting the internal surface of a pipe using the internal weld blasting system of claim 1, comprising:

a. disposing the internal weld blasting system in a pipe;

b. transporting abrasives into the internal weld blasting system;

c. supplying the abrasives to the blast wheel by the centrifugal force of the impeller; and d. spraying the abrasives onto the internal surface of the pipe by the centrifugal force of the blast wheel; wherein the centerline of the spray pattern is 50 degrees from the centerline of the pipe.

20. The internal weld blasting system of claim 1, having a single blast wheel.

* * * * *